US006431503B1

(12) United States Patent
Horan

(10) Patent No.: US 6,431,503 B1
(45) Date of Patent: Aug. 13, 2002

(54) LAWN BAG HOLDER

(76) Inventor: Tom Horan, 1021 Saint Charles Dr., Annapolis, MD (US) 21401

( * ) Notice: Subject to any disclaimer, the term of this patent is extended or adjusted under 35 U.S.C. 154(b) by 0 days.

(21) Appl. No.: 09/935,627

(22) Filed: Aug. 24, 2001

(51) Int. Cl.[7] ..... B65B 67/04
(52) U.S. Cl. ..... 248/101
(58) Field of Search ..... 248/95, 97, 99, 248/100; 141/390, 391; 220/404

(56) References Cited

U.S. PATENT DOCUMENTS

| | | | | | |
|---|---|---|---|---|---|
| 4,006,928 | A | | 2/1977 | Beugin | |
| 4,037,778 | A | * | 7/1977 | Boyle | 229/55 |
| 4,664,348 | A | * | 5/1987 | Corsaut, III et al. | 248/99 |
| 4,832,291 | A | * | 5/1989 | Nelson et al. | 249/99 |
| 4,951,903 | A | * | 8/1990 | Frey | 248/99 |
| 5,011,103 | A | | 4/1991 | Hayes et al. | |
| 5,014,943 | A | | 5/1991 | Nelson et al. | |
| 5,031,948 | A | | 7/1991 | Groth et al. | |
| 5,065,965 | A | | 11/1991 | Aulabaugh | |
| 5,090,756 | A | | 2/1992 | Pfisterer | |
| 5,129,609 | A | * | 7/1992 | Tobin | 248/97 |
| 5,180,125 | A | | 1/1993 | Caveney | |
| 5,180,126 | A | | 1/1993 | Bennett | |
| 5,222,536 | A | | 6/1993 | Hodgdon et al. | |
| 5,308,027 | A | | 5/1994 | Fullilove | |
| 5,413,394 | A | | 5/1995 | Mitchell | |
| 6,003,820 | A | * | 12/1999 | Baldonado et al. | 248/99 |

FOREIGN PATENT DOCUMENTS

| | | |
|---|---|---|
| GB | 2 212 383 A | 7/1989 |
| SE | 53814 | 10/1921 |

* cited by examiner

*Primary Examiner*—Ramon O. Ramirez
*Assistant Examiner*—Kofi Schulterbrandt
(74) *Attorney, Agent, or Firm*—Richard C. Litman

(57) ABSTRACT

A versatile folding lawn bag holder usable on a grassy lawn to hold open a bag in an open horizontal position and which is also attachable to a rack rail on a wall in a utility room or garage to hold a plurality of bags in an open vertical position. The bag holder has a base platform with a front ramp for sweeping debris up into a lawn bag, and a pair of inwardly arched and hinged foldable arms holding the mouth of the lawn bag open. A pair of pins on each arcuate arm help to retain the lawn bag on the arcuate arms. A pair of blind bores on the bottom surface of the base platform which cooperate with knobs on the rack rail to hang the holder on a wall.

9 Claims, 5 Drawing Sheets

LAWN BAG HOLDER

BACKGROUND OF THE INVENTION

1. Field of the Invention

The present invention relates generally to a lawn bag holder and, more specifically, a base platform having a pair of arcuate folding arms to secure the opening of the lawn bag on the ground. Multiple lawn bag holders may be attached to a rail mounted on a wall for holding multiple bags open.

2. Description of the Related Art

The related art of interest describes various bag holders, but none discloses the present versatile invention. There is a need for an economical folding lawn bag holder deployable on a lawn, or in which multiple holder units are removably securable to a wall of a utility room or garage to hold multiple bags open.

The related art will be discussed in the order of perceived relevance to the present invention.

U.S. Pat. No. 5,065,965 issued on Nov. 19, 1991, to R. Michael Aulabaugh describes a trash bag holder comprising either a foldable five-sided box frame or a three-sided frame. The frames have a narrow forward lip. The three-sided frame has a stiff wire to space the sides which can be folded inward. A handle is provided on its bottom panel for hanging. The side panels are triangular in shape. The five-sided box frame can be folded with two opposite sides having longitudinal hinges. The trash bag holders are distinguishable for requiring planar foldable sides and either a stiff wire or planar top panel for holding the side panels open.

Sweden Patent No. 53814 issued on Oct. 11, 1921, to E.R.C.K. von Scheele describes a bag holder comprising a rectangular base platform formed with four rods supporting a hinged side frame of a pair of rods, and a U-shaped pivoting crossbar. The upper leg of each side frame has a spring attached to the base platform. The bag holder is distinguishable for its required upper crossbar, hinged side frame and springs.

U.S. Pat. No. 5,222,536 issued on Jun. 29, 1993, to Marion Y. Hodgdon et al. describes a rectangular and collapsible refuse collector frame with a hinged collection tray with sidewalls for holding a plastic trash bag open in a horizontal or vertical position by its two U-shaped expander arms. Four hinge joints permit the collapse of the frame and the tray. The refuse collector frame is distinguishable for its rectangular opening and extended U-shaped expander arms.

U.S. Pat. No. 5,308,027 issued on May 3, 1994, to Tom P. Fullilove describes a dual use leaf bagger having an adjustable rectangular pipe frame, wherein the sides telescope via cotter pins and supported by a flexible clamp. The bottom pipe supports a bent plate providing a front ramp and a rear ramp. The frame can be used on the ground to support a trash bag and on a wall by fastening the plate to the wall. The leaf bagger is distinguish-able for its closed rectangular frame, telescopic sides and the front and rear ramps.

U.S. Pat. No. 4,006,928 issued on Feb. 8, 1977, to Louis E. Beugin describes a lawn bag caddy consisting of a rectangular wire frame which is adjustable in height via resilient sleeves. The rectangular frame is supported by a central strut and two bottom legs joined at the rear. A handle loop is provided on the top of the rectangular frame. The lawn bag caddy is distinguishable for its wire frame construction and triangular bag support structure.

U.S. Pat. No. 4,832,291 issued on May 23, 1989, to Dean O. Nelson describes a trash bag holder comprising a semicircular hoop band having a hinge on one side and hinged at both ends to a rigid flat member. The flat member is hinged to a rectangular pan having raised sides and a lowered front edge. The flat member can act as threshold or a lid when the bag is upright. The trash bag holder is distinguishable for its semicircular shaped opening with an extensive rectangular pan having upright side flanges and a front inclined edge.

U.S. Pat. No. 5,014,943 issued on May 14, 1991, to Dean O. Nelson et al. describes a trash bag holder similar to that described above except the pan portion is semicircular shaped with stiffening ribs. The bag holder is distinguishable for its semicircular shaped opening with a semicircular shaped pan and cover.

U.S. Pat. No. 5,031,948 issued on Jul. 16, 1991, to James A. Groth et al. describes a bag handling system comprising an inner locking frame secured in the channel of an outer base frame which includes a hand grip and rails for the attachment of an extension handle/support leg. The system is distinguishable for its required inner and outer locking frame construction with an extension handle/support leg and a hand grip.

U.S. Pat. No. 5,090,756 issued on Feb. 25, 1992, to Dieter E. Pfisterer describes a material compacting device comprising a structure configured as a base panel with two side panels having parallelogram shaped front sections held together by straps and tied to a cord or rod in front. The device is distinguishable for its unique frame structure.

U.S. Pat. No. 5,011,103 issued on Apr. 30, 1991, to Franklin A. Hayes et al. describes a collapsible frame for an integrated nylon leaf bag comprising an upright flexible wire arch and a horizontal wire arch joined by stabilizing feet structures. The nylon bag is attached permanently to the upper wire arch. The collapsible frame and leaf bag device is distinguishable for its integrated lawn bag and wire frame structure.

U.S. Pat. No. 5,018,125 issued on Jan. 19, 1993, to Robert D. Caveney describes a device for loading bags comprising a rectangular box structure with three open sides as a first embodiment. The top and bottom frames have handles and can be hinged. Another embodiment has semicircular frame with a pair of legs. A further embodiment employs a square frame with inclined sides and a pair of stubby legs positioned on opposite sides. The various devices are distinguishable for their box shapes and legs.

U.S. Pat. No. 5,180,126 issued on Jan. 19, 1993, to Charles O. Bennett describes a leaf caddy comprising a rectangular telescopic frame made from polyvinyl chloride pipe and elbows. The vertical front frame member has a T-connection on top to the inclined rear support frame member. The leaf caddy can be utilized horizontally and vertically with support against a tree trunk. The leaf caddy is distinguishable for its rectangular collapsible structure.

U.S. Pat. No. 5,413,394 issued on May 9, 1995, to Marilyn Mitchell describes a handling device for a plastic trash bag comprising a D-shaped frame with a pivoting long handle attached it its apex. The bag is secured by a clamp ring on the handle. The device is distinguishable for its D-shaped structure and requirement for a long handle.

Great Britain Patent Application No. 2 212 383 A published on Jul. 26, 1989, for George F. H. Peacock describes a refuse bag support device comprising a D-shaped ring in a first embodiment supported by a pair of rollers and either a short or long handle in a socket on the ring. A second embodiment employs an upright bent rod supporting the D-shaped ring by three feet members. A third embodiment uses two ring members made from plastic coated wire supported by three leg members. The support devices are distinguishable for the wire supports and handles.

None of the above inventions and patents, taken either singularly or in combination, is seen to describe the instant invention as claimed. Thus, a lawn bag holder solving the aforementioned problems is desired.

SUMMARY OF THE INVENTION

The present invention is directed to a versatile folding lawn bag holder which can be utilized on a lawn to hold a lawn bag open. Multiple holder units may be hung on a rack of a utility room or garage to hold several bags open. The holder unit has a base platform which supports two foldable arched arms to secure a lawn bag in an open position. The base platform has a pair of apertures on its bottom surface which cooperate with knobs on a horizontal rack hung on a wall for supporting a plurality of bags in a vertical position.

Accordingly, it is a principal object of the invention to provide a multi-use lawn bag holder.

It is another object of the invention to provide a portable lawn bag holder having a base platform and two arcuate folding arms for supporting a lawn bag in an open position on a lawn surface.

It is a further object of the invention to provide a portable lawn bag holder having a base platform with a pair of apertures on its bottom surface.

Still another object of the invention is to provide a plurality of lawn bag holders for holding lawn bags in a vertical position by providing a horizontally positioned wall rack having knobs which cooperate with the blind bores in the base platforms of the lawn bag holders.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
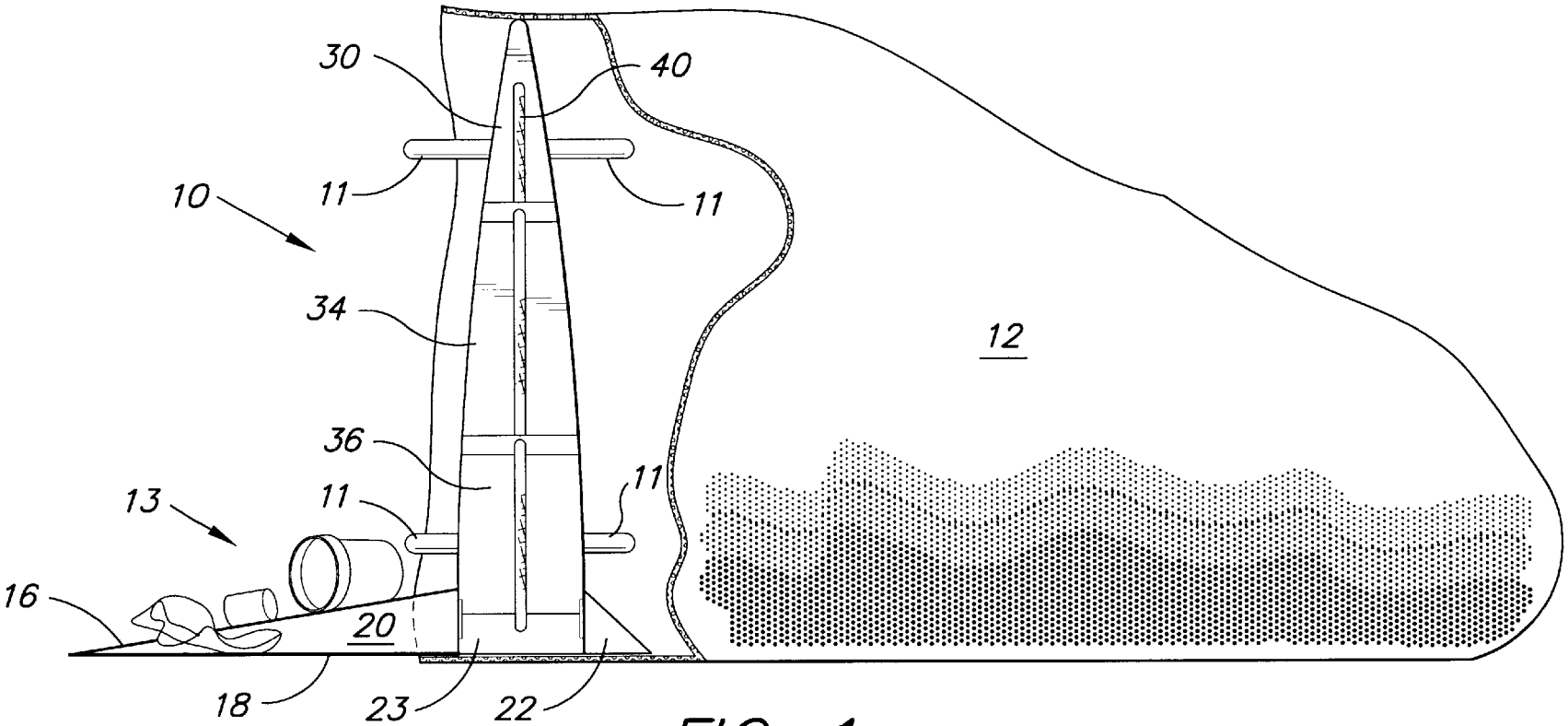
FIG. 1 is an environmental, side elevational view of a first embodiment of a lawn bag holder partially in shadow holding a lawn bag open for filling according to the present invention.
Figure 2:
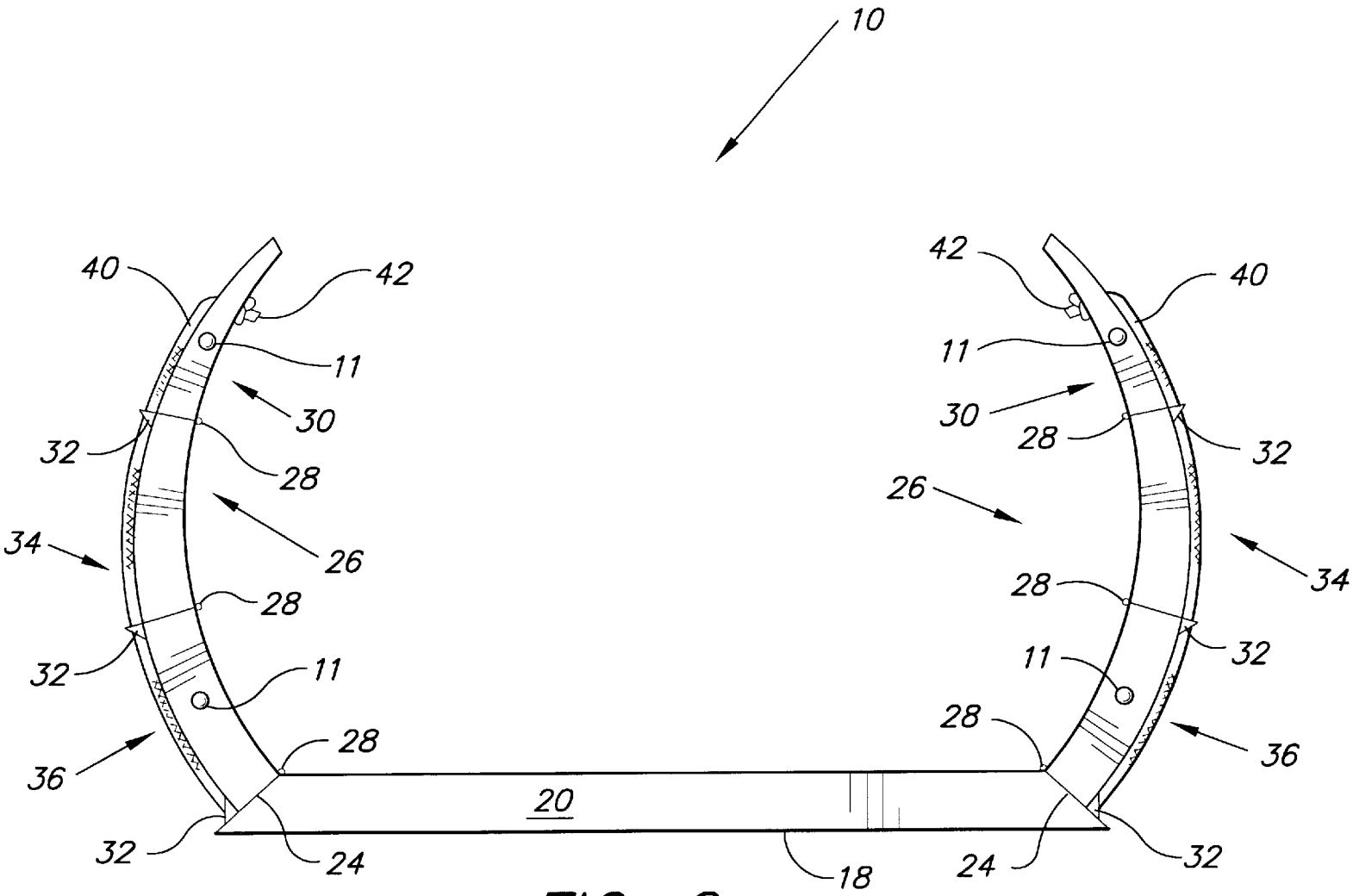
FIG. 2 is a front elevational view of the bag holder of the FIG. 1 embodiment.
Figure 3:
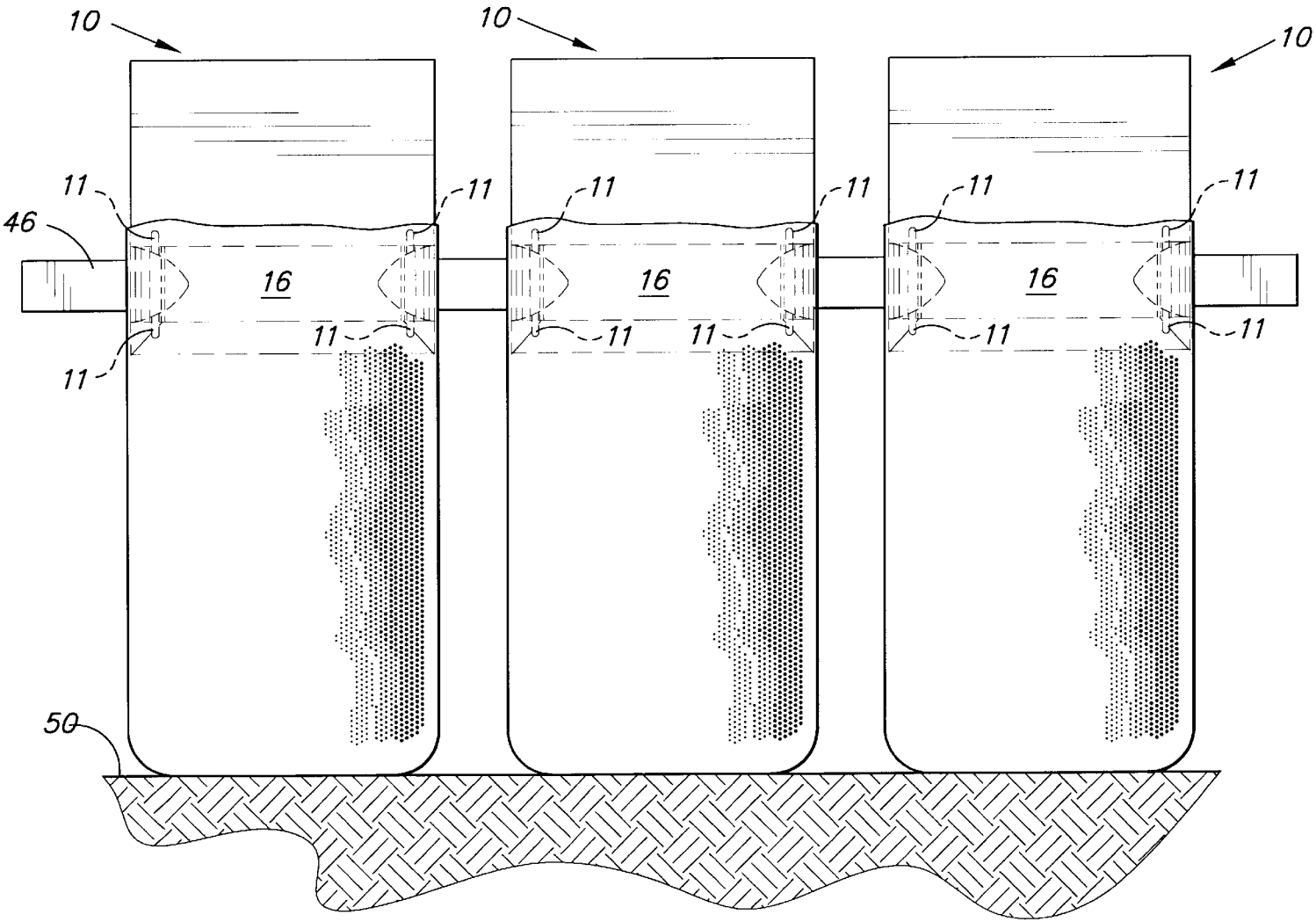
FIG. 3 is an environmental, front elevational of a multiple bag holder on a wall rack rail as a second embodiment.
Figure 4:
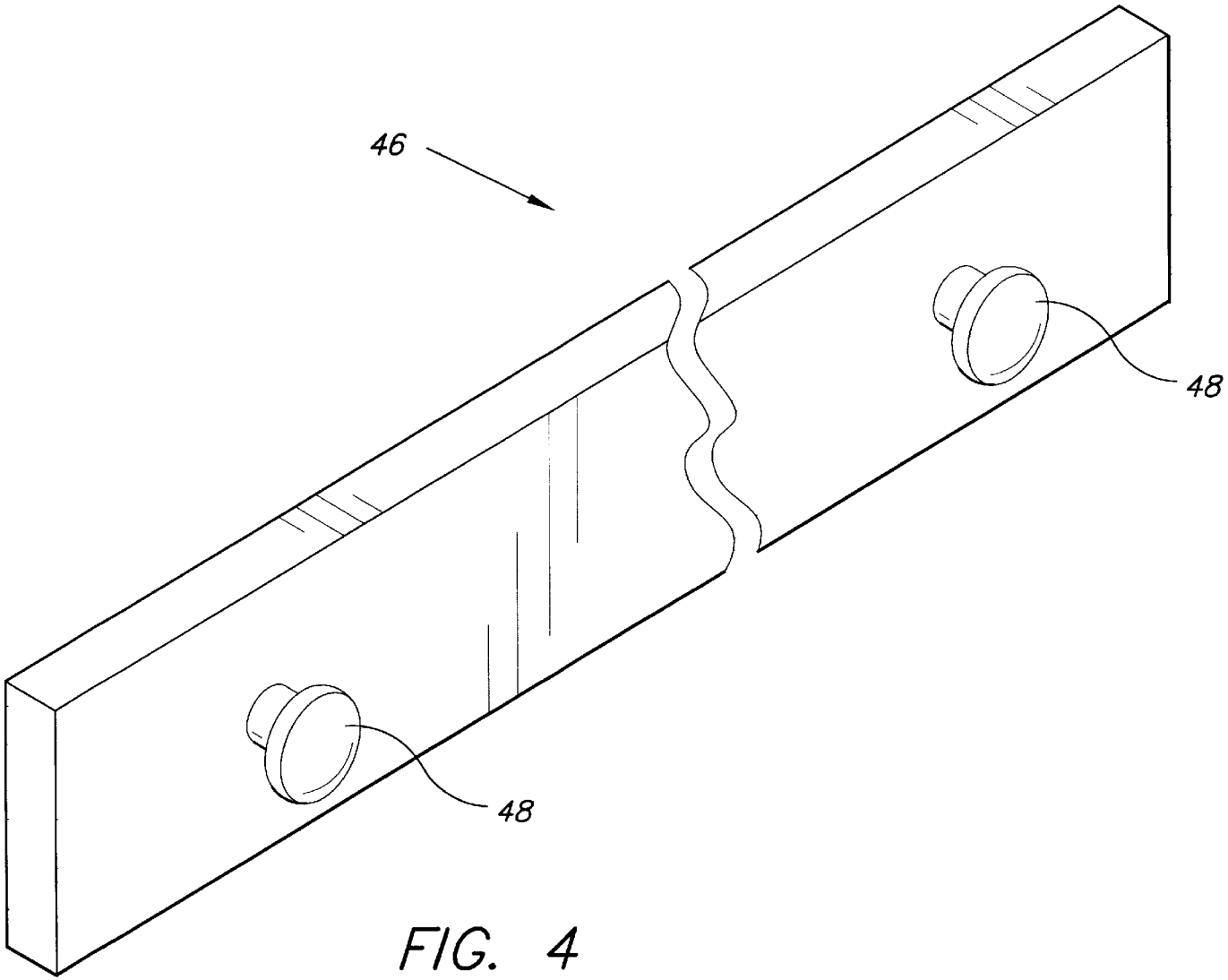
FIG. 4 is a perspective view of the wall rack rail in FIG. 3 having at least two knobs illustrated.
Figure 5:
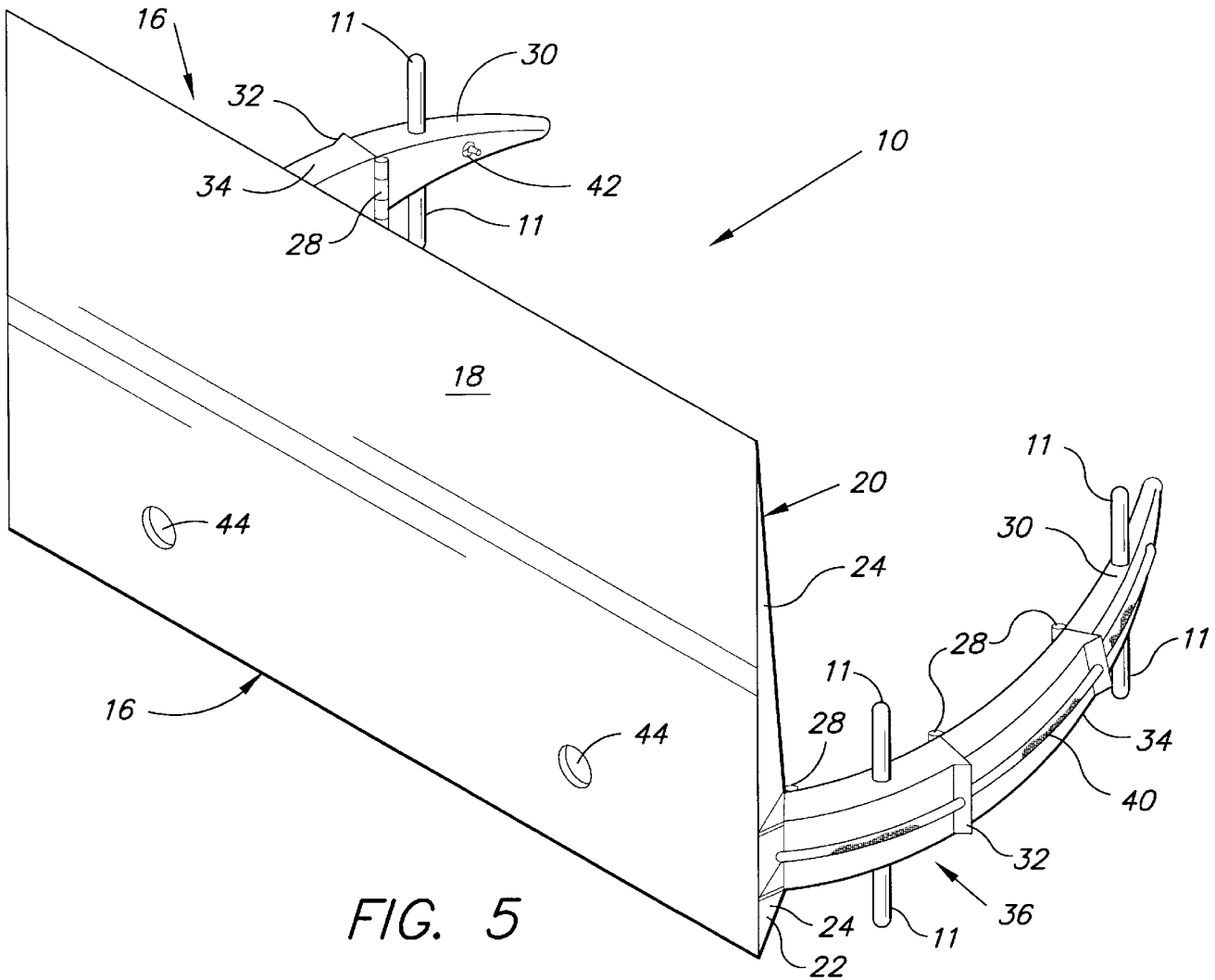
FIG. 5 is a perspective view of an individual bag holder having a pair of apertures in its bottom surface for attachment to the FIG. 3 rail.

The present invention provides a versatile lawn bag holder 10 which may be used as an individual stand-alone unit for use on the lawn to hold bags 12 open for picking up debris 13, as shown in FIG. 1, or which may be deployed in multiple units mounted against a wall in a utility room or garage, as shown in FIG. 3. As shown in FIGS. 1, 2 and 5, an individual lawn bag holder unit 10 has a base platform 16 having a flat bottom 18, an elongated front wedge-shaped ramp 20, a short, steeper rear wedge-shaped ramp 22, a short, flat plateau 23 between the ramps 20 and 22, and two side surfaces 24.

A pair of segmented, hinged arcuate arms 26 are attached to opposite sides 24 of the base platform 16 between the two ramps 20 and 22. Each arm 26 preferably has three segments, including a proximal segment 36 attached to the platform 16, an intermediate segment 34 attached to the proximal segment 36, and a distal segment 30 attached to the intermediate segment 34. The arms 26 are articulated by hinges 28 between the proximal segments 36 and the platform 16 and between the inner aspect of adjacent segments so that the arms 26 may be folded for compact storage. The proximal segments 36 and the intermediate segments 34 each have a projection 32 extending to the outer aspect of the distal end of the segment. An elastic cord 40, such as a bungee cord, has a central portion disposed in the hollow interior of the central plateau 23 of the base platform 16, with opposite ends of the cord 40 exiting the platform 16 and being guided along the outer aspect of the arcuate arms 26 through holes defined in the projections 32, passing through holes defined in the distal segments 36 to the interior aspect of the arms 26, where they are secured in any conventional manner, as by tying knots 42 in the ends of the cord 40. The elastic cord 40 provides tension on the outer aspect of the arms 26 to better support irregularly shaped bags. Each arm 26 has a first pin 11 extending through the proximal segment 36 parallel to the ramps 20 and 22, and a second pin 11 extending through the distal segment 30 parallel to the ramps 20 and 22. The pins 11 are used for securing the lawn bags to the arms 26.

As shown in FIG. 1, in use a lawn bag 12 is placed on the ground with the platform 16 placed just inside the mouth of the bag 12 and the arcuate arms 26 holding the mouth of the bag 12 open. Debris 13 is swept or raked up the elongated ramp 20. The ramp 20 defines an inclined plane so that round or cylindrical objects can be rolled up the ramp 20. The rear ramp 22 provides stability to the platform 16.

As shown in FIG. 5, each lawn bag holder 10 has a pair of apertures 44 on its bottom surface 18 for attaching onto a rectangular rack rail 46 hung on a wall of a utility room or garage. As shown in FIG. 3, the rack rail 46 has knobs or pegs 48 which cooperate by insertion in the apertures 44 for attachment of a plurality of the lawn bag holders units 10 for holding open the mouth of bags 12 which rest on the floor 50. It will be obvious to those skilled in the art that the apertures 44 may be formed as slotted holes with a hole large enough to receive the knob 48 and a narrower slot extending from the hole to receive the shaft of the peg 48 to prevent the holder 10 from falling off the rail 46, if desired. It should be noted that the bag holders 10 are mounted on the rack rail 46 with the extended front wedge-shaped ramp 20 directed upward towards the ceiling. Thus, the bags 12 can separate refuse such as glass bottles, metal cans and paper products for collection by environmental agencies.

Preferably, the lawn bag holder is made of rigid plastic which may be formed by injection molding or other plastic forming techniques.

It is to be understood that the present invention is not limited to the embodiments described above, but encompasses any and all embodiments within the scope of the following claims.

I claim:

1. A lawn bag holder comprising:

a base platform having a flat bottom, an elongated front wedge-shaped ramp, a short rear wedge-shaped ramp, a flat central plateau disposed between the front ramp and the rear ramp, and two opposing sides; and a pair of segmented, articulated arcuate arms positioned on the opposing sides of the base platform proximate the central plateau;

whereby the platform can be placed inside a mouth of a lawn bag with the arcuate arms holding the mouth open so that debris may be swept up the front ramp into the lawn bag.

2. The lawn bag holder according to claim 1, wherein each said arcuate arm comprises:

a proximal segment connected to said base platform;

an intermediate segment connected to said proximal segment; and a distal segment connected to said intermediate segment, each said arcuate arm having an inner aspect facing said base platform and an outer aspect facing away from said base platform.

3. The lawn bag holder according to claim 2, further comprising a pair of hinges connecting the proximal segments of each said arcuate arm to said base platform, whereby said arcuate arms may be folded over said platform for compact storage.

4. The lawn bag holder according to claim 2, wherein each said arcuate arm further comprises:

a first hinge connecting the proximal segment to the intermediate segment; and a second hinge connecting the intermediate segment to the distal segment, said first and second hinges being disposed on the inner aspect of said arcuate arm;

whereby said arcuate arms are articulated.

5. The lawn bag holder according to claim 2, wherein:

the proximal segment and the distal segment of each said arcuate arm further comprise a projection extending to the outer aspect of said arcuate arm, each projection having a guide hole defined therein;

the distal segment of each said arcuate arm has a terminal hole defined therein extending from the outer aspect to the inner aspect;

the central plateau of said base platform is hollow; and the lawn bag holder further comprises an elastic cord disposed in the hollow central plateau and having opposite ends exiting said base platform and extending on the outer aspect of said arcuate arms, passing through the guide holes in said projections and passing through the terminal holes defined in the distal segments, the opposite ends being secured on the inner aspects of the distal segments;

whereby tension is placed on said arcuate arms for holding irregular size lawn bags.

6. The lawn bag holder according to claim 1, wherein the flat bottom of said base platform has a pair of apertures defined therein adapted for attaching the lawn bag holder to a wall mounted rack having pegs which fit through the apertures.

7. The lawn bag holder according to claim 6, further comprising rack rail having a plurality of pegs, the rack rail being adapted for attachment to a vertical surface, whereby a plurality of the lawn bag holders may attached to the rack rail for hanging a plurality of open lawn bags from the vertical surface.

8. The lawn bag holder according to claim 1, wherein the lawn bag holder is substantially made of rigid plastic.

9. The lawn bag holder according to claim 1, wherein each said arcuate arm further comprises a pair of spaced apart pins extending through said arcuate arm parallel to said front ramp and said rear ramp for attaching a lawn bag to the lawn bag holder.

* * * * *